United States Patent [19]

Tsymberov

[11] Patent Number: 5,012,898

[45] Date of Patent: May 7, 1991

[54] CONTROL SYSTEM FOR VEHICLE LIFT RACKS

[75] Inventor: Anatoly Tsymberov, Ballwin, Mo.

[73] Assignee: Hunter Engineering Company, Bridgeton, Mo.

[21] Appl. No.: 244,284

[22] Filed: Sep. 15, 1988

[51] Int. Cl.[5] ..... B66F 7/08; F15B 7/00; F15B 15/26

[52] U.S. Cl. ..... 187/8.47; 187/8.5; 187/17; 60/399; 60/420; 60/463; 60/464; 60/481; 91/532; 91/515; 91/420; 91/406

[58] Field of Search ..... 187/17, 8.47, 8.41, 187/8.43, 8.49, 8.50; 60/399, 420, 459, 460, 461, 463, 464, 466, 477, 467, 468, 489, 481; 91/420, 404, 405, 406, 47, 171, 515, 189 R, 532

[56] References Cited

U.S. PATENT DOCUMENTS

| | | | |
|---|---|---|---|
| 2,201,147 | 5/1940 | Bary et al. | 254/91 |
| 2,201,189 | 5/1940 | Makaroff et al. | 254/91 |
| 2,208,983 | 7/1940 | Jackson et al. | 254/91 |
| 2,245,417 | 6/1941 | Schlarmann | 254/91 |
| 3,289,868 | 12/1966 | Miller et al. | 214/515 |
| 3,494,259 | 2/1970 | Sumida | 91/471 |
| 3,677,099 | 7/1972 | Thatcher | 91/171 X |
| 3,760,688 | 9/1973 | Dummer | 91/412 |
| 3,783,976 | 1/1974 | Kerr | 187/8.47 X |
| 4,091,715 | 5/1978 | Onderka | 91/420 X |
| 4,205,591 | 6/1980 | Mickelson | 91/420 X |
| 4,323,141 | 4/1982 | Ragan et al. | 187/8.47 |
| 4,403,680 | 9/1983 | Hillesheimer | 187/18 |
| 4,505,339 | 3/1985 | Kramer et al. | 91/420 X |
| 4,526,346 | 7/1985 | Galloway et al. | 187/18 X |
| 4,638,886 | 1/1987 | Marietta | 187/17 |
| 4,638,888 | 1/1987 | Coy | 187/17 |
| 4,706,458 | 11/1987 | Corghi | 60/546 |
| 4,724,930 | 2/1988 | Van Lierop | 187/8.43 |
| 4,761,120 | 8/1988 | Mayer et al. | 417/404 |

*Primary Examiner*—Michael S. Huppert
*Assistant Examiner*—Kenneth DeRosa
*Attorney, Agent, or Firm*—Gravely, Lieder & Woodruff

[57] ABSTRACT

A control system for the hydraulic operating circuit associated with a vehicle lifting device in which the circuit is provided with pressure fluid control valves and flow sensors which are operative on the vehicle lowering cycle to establish substantial evenness of the lowering mechanism and protection against malfunction of an operating component to arrest the travel of the vehicle lifting device in its lowering cycle.

2 Claims, 6 Drawing Sheets

CONTROL SYSTEM FOR VEHICLE LIFT RACKS

BACKGROUND OF THE INVENTION

1. Field of the Invention

This invention relates to a control for the hydraulic system in vehicle lift racks in which the supporting runways are elevated by single action pressure fluid rams and are lowered by the weight of the vehicle on the runways or simply by gravity.

2. Description of the Prior Art

Applicant is aware of hydraulic automobile lift mechanisms having runways adapted to be elevated by mechanical interconnecting devices operated from a common hydraulic power source. The problem with such mechanisms is that they are required to have below-ground excavations for some of the operating devices. Examples of the foregoing prior art are 2,201,147 of May 21, 1940; 2,201,189 of May 21, 1940; 2,208,983 of July 23, 1940; and 2,201,147 of June 10, 1941.

In the field of above ground surface-mounted lifting mechanisms, applicant is aware of such art as 3,289,868 of Dec. 6, 1966; 4,706,458 of Nov. 17, 1987; and 4,724,930 of Feb. 16, 1988. Other examples of mechanisms having multiple lifting rams requiring synchronous operation are 3,494,259 of Feb. 10, 1970; 3,760,688 of Sept. 25, 1973; 4,403,680 of Sept. 13, 1983; and 4,526,346 of July 2, 1985.

The problems with the noted prior art examples are the complex construction devised to handle loads requiring elevation, leakage that can develop after a period of use, and lack of accuracy in obtaining simultaneous movement of the separate lifting runways to protect the load from tipping. That is especially important when the load is an automobile or truck. An additional problem in handling fluid displacement rams is how to maintain the volume of fluid substantially the same in each flow system.

BRIEF SUMMARY OF THE INVENTION

It is an important object of the present invention to provide a pressure fluid system and hydraulic motor means for each of the separate vehicle supporting runways with a control system which will coordinate the raising and lowering travel of the runways so that neither runway will seriously lead or lag the other to thereby preserve the levelness of a vehicle that is on the runways.

Another important object of the invention is to incorporate a fluid divider control system in a vehicle hoisting runway apparatus so that the system will function to immediately sense when one of two separate runways has ceased movement. This function is important when lowering a vehicle, and calls for arresting the movement of the runway that is free to move.

Additionally the present invention, as it relates to vehicle lifting apparatus having a pair of separate runways, has as an important object the provision of a control system of relatively simple construction which establishes a desired degree of safe operation to protect against substantial unequal travel of either one of a pair of runways.

Other objects of the invention will be referred to as the detailed disclosure of the apparatus proceeds.

BRIEF DESCRIPTION OF THE DRAWINGS

The embodiments of the present invention are shown in the accompanying drawings, wherein.

DETAILED DESCRIPTION OF THE PREFERRED EMBODIMENTS

Figure 2:
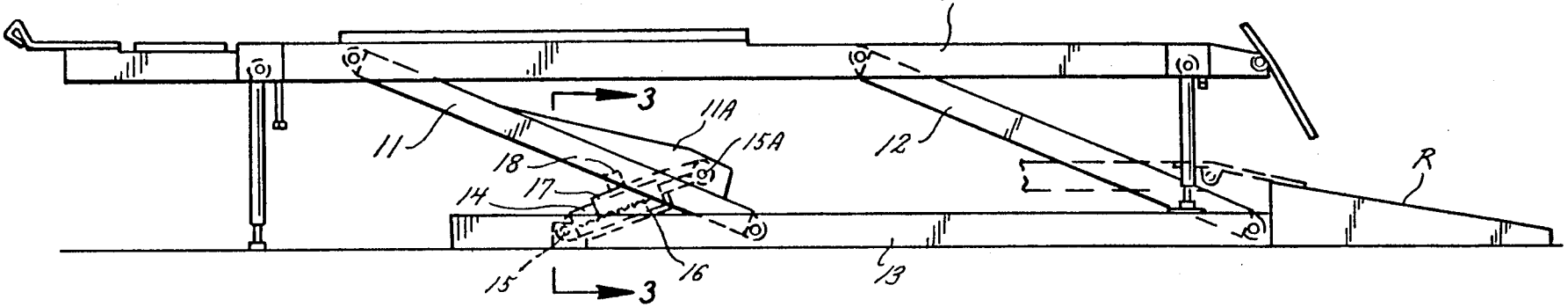
FIG. 2 is a view taken along line 2—2 in FIG. 1 of a typical arrangement of the working components for lifting and lowering the runways.

It will be recognized by those skilled in the relevant art of vehicle service equipment that the typical vehicle rack is equipped with a pair of runways (10) (only one being seen in FIG. 2). These runways are typically raised and lowered by pairs of lifting legs 11 and 12 which are pivotally mounted on and supported by a base 13. Legs 11 represent the front legs of the rack assembly, and legs 12 represent the rear legs of the rack assembly. The front legs 11 for each runway 10 are actuated by a pressure fluid motor means or cylinders 14, operatively mounted by a pivot shaft 15 to the base 13 and having the power rod 14A pivotally connected by a pivot 5A to a gusset 11A on legs 11. As noted above, the opposite unseen runway is similarly provided with pairs of legs 11 and 12.

Figure 6:
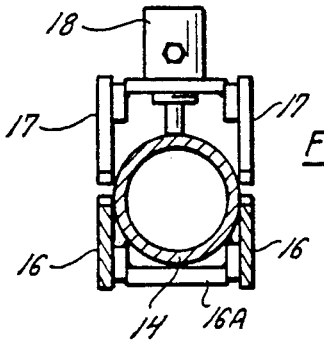
FIG. 6 is a detailed view of the assembly of FIG. 5 taken along line 6—6.

The rack seen in FIG. 2 is provided with a ratchet mechanism (See FIGS. 2-6) at each pressure fluid motor means or cylinder 14. The ratchet mechanism comprises a pair of toothed members 16 fixed by shaft 15 adjacent to one end of the motor means 14 and fixed by bracket means 16A to the opposite end. A pair of moveable toothed dogs 17 connected by bracket means 17A move with the dogs from a pivot shaft 15A coincident with the power rod 14A of the motor means. The toothed dogs are gravity-influenced into engagement with the toothed members 16 to lock the power rod against retracting. When engaged, the toothed dogs 17 have teeth shaped to ride over the ratchet teeth on members 16 during elevating of the runway, but for reverse movement of the runways, the teeth on the dog will firmly engage the ratchet teeth. The means for disengaging the toothed dogs 17 from the ratchet member 16 is a pressure fluid motor means 18 which, when pressurized, holds the dogs in disengaged positions (See FIGS. 5 and 6). It is understood that only on raising the runways 10, the teeth on dogs 17 will click over the teeth on members 16 and produce an audible sound. When the runways are to be lowered, it is first necessary to release the load on the ratchet and dog teeth so the first function is to supply pressure fluid to motor means 14 to raise the runways 10 sufficiently to disengage the teeth of the ratchet and dog. This disengagement is followed almost immediately by pressure fluid admitted to the motor means 18 to hold the teeth of the ratchet and dog disengaged so the runways 10 are then free to lower under their own weight, as well as the weight of a vehicle which may be supported on the runways.

Figure 7:
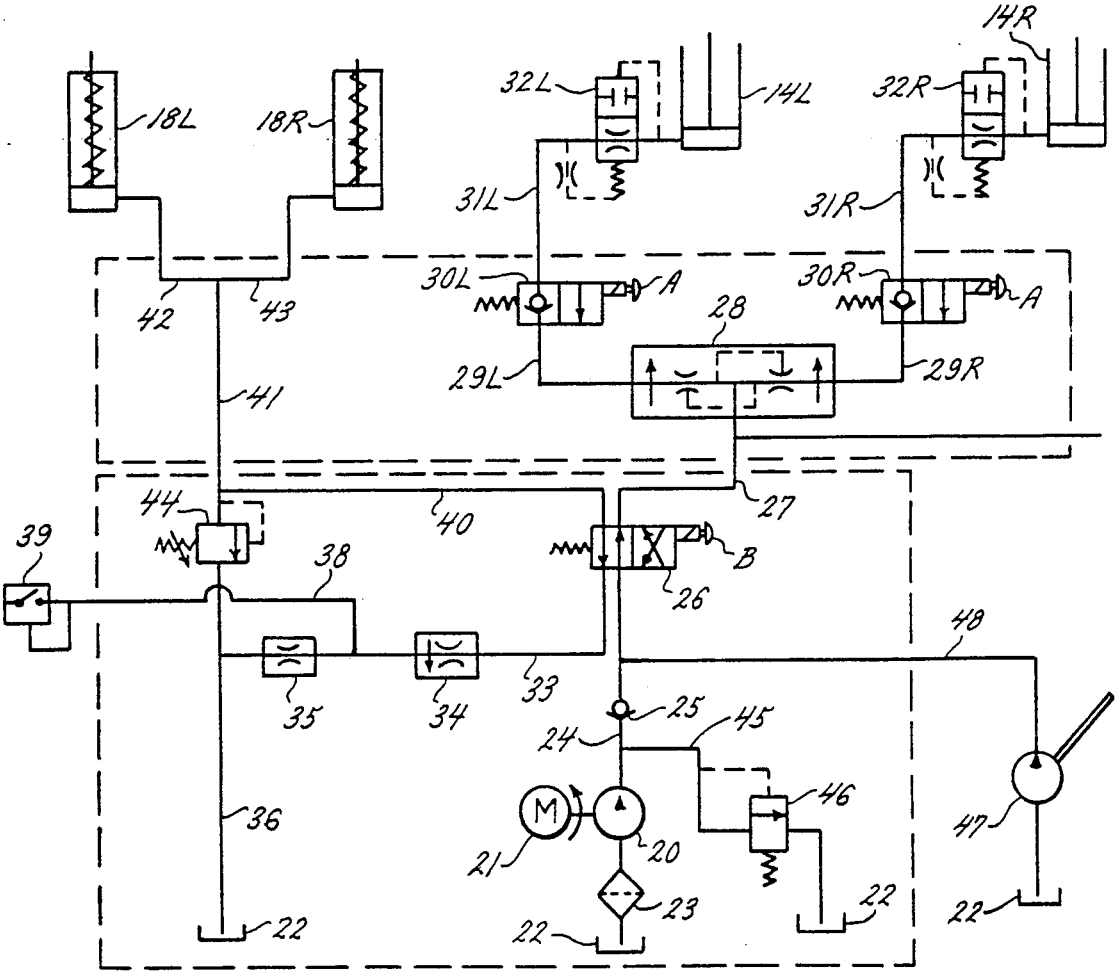
FIG. 7 is a schematic pressure fluid diagram showing the organization of the components in the control system.

Turning to FIG. 7 for a view of the pressure fluid diagram, it can be seen that the diagram simply shows separate pressure fluid motor means or cylinders denominated 14L and 14R. In this view, the components will be indicated by reference numerals followed by the letters L for left and R for right, since there are left and right runways. With that understanding, FIG. 7 discloses a common pressure fluid pump 20 driven by a suitable motor 21. The pump draws the fluid from a reservoir 22 through a filter 23. The pressure fluid is delivered by conduit 24 past a reverse flow check valve 25 to a suitable four-way directional control valve 26. The fluid flow in conduit 27 from valve 26 is directed into a flow divider/combiner 28 where the pressure fluid divides into a left conduit 29L and into a right conduit 29R. Conduit 29L connects with the inlet port of a 2-way valve 30L on the check valve inlet side, and the outlet conduit 31L is connected into a suitable velocity fuse device 32L which functions for safety reasons as is well understood.

In like manner, pressure fluid from the conduit 27 enters the divider/combiner 28 and flows into the right hand two-way valve 30R, and from there the fluid is directed by conduit 31R through a suitable velocity fuse 32R into the pressure fluid motor means 14R.

The four-way valve 26 is connected into a second pressure fluid circuit by a conduit 33 which is connected with a pressure compensated flow control valve 34 having a set point of two gallons per minute, 2GPM, and from there conduit 33 connects into a pressure restriction device 35 and by conduit 36 to return pressure fluid to the reservoir 22. There is a branch conduit 38 from conduit 33 which leads to a pressure sensing switch 39 of conventional design.

Figure 4:
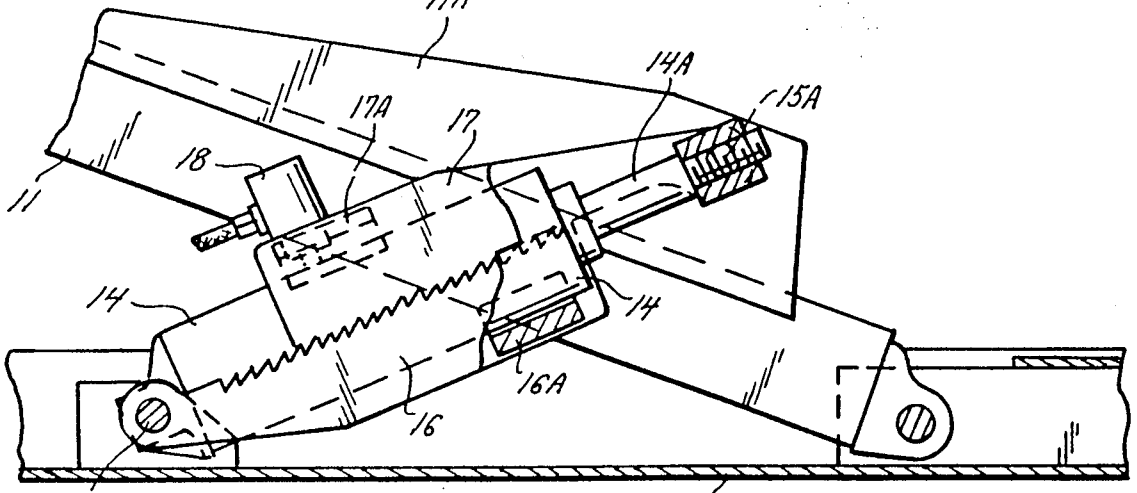
FIG. 4 is a fragmentary side elevation of a typical locking type ratchet assembly in the locked position.
Figure 3:
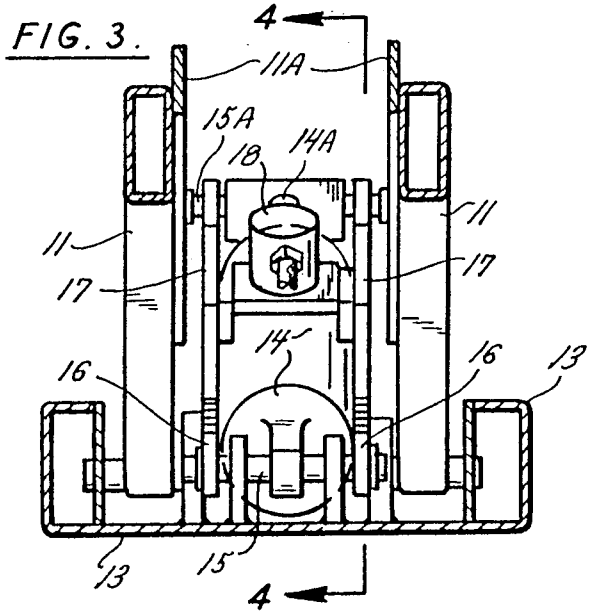
FIG. 3 is a detailed view taken along line 3—3 in FIG. 2 to show the motor means and locking assembly.
Figure 5:
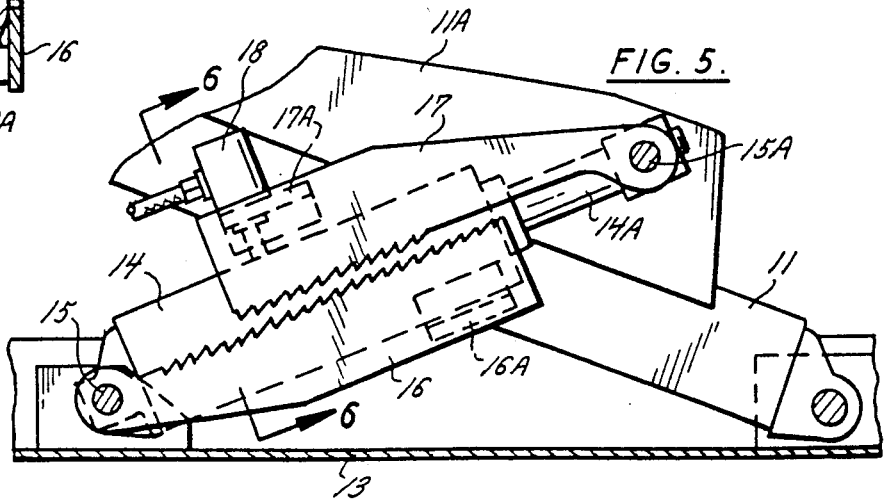
FIG. 5 is a view similar to FIG. 4 but with the ratchet assembly in unlocked condition.

As pointed out above, the pressure fluid four-way valve 26 is connected by a branch conduit 40 into a conduit 41 which directs pressure fluid into the branch conduits 42 and 43 connected respectively to the pressure fluid motor means 18R and 18L for the ratchet device 14-16 in FIG. 4. Similarly, branch conduit 43 connects into pressure fluid motor means (not shown for the opposite legs 11) for a ratchet device similar to device 17. The pressure fluid in conduit 41 is also connected through a pressure relief valve 44 to conduit 36 and back into reservoir 22.

The pressure fluid system supply line 24 adjacent to the pump 20 is protected by a fluid bypass circuit 45 to the reservoir 22 through a pressure relief valve 46 which is actuated at a maximum desired bypass pressure to return the fluid back to the reservoir 22. In the event pump 20 loses its electric motor 21, the system is provided with a manually-operated pump 47 for drawing fluid from reservoir 22 and delivering the same to conduit 48 which connects with the main delivery conduit 24 on the delivery side of the check valve 25.

HYDRAULIC SYSTEM OPERATION ON RACK ELEVATION

Figure 8:
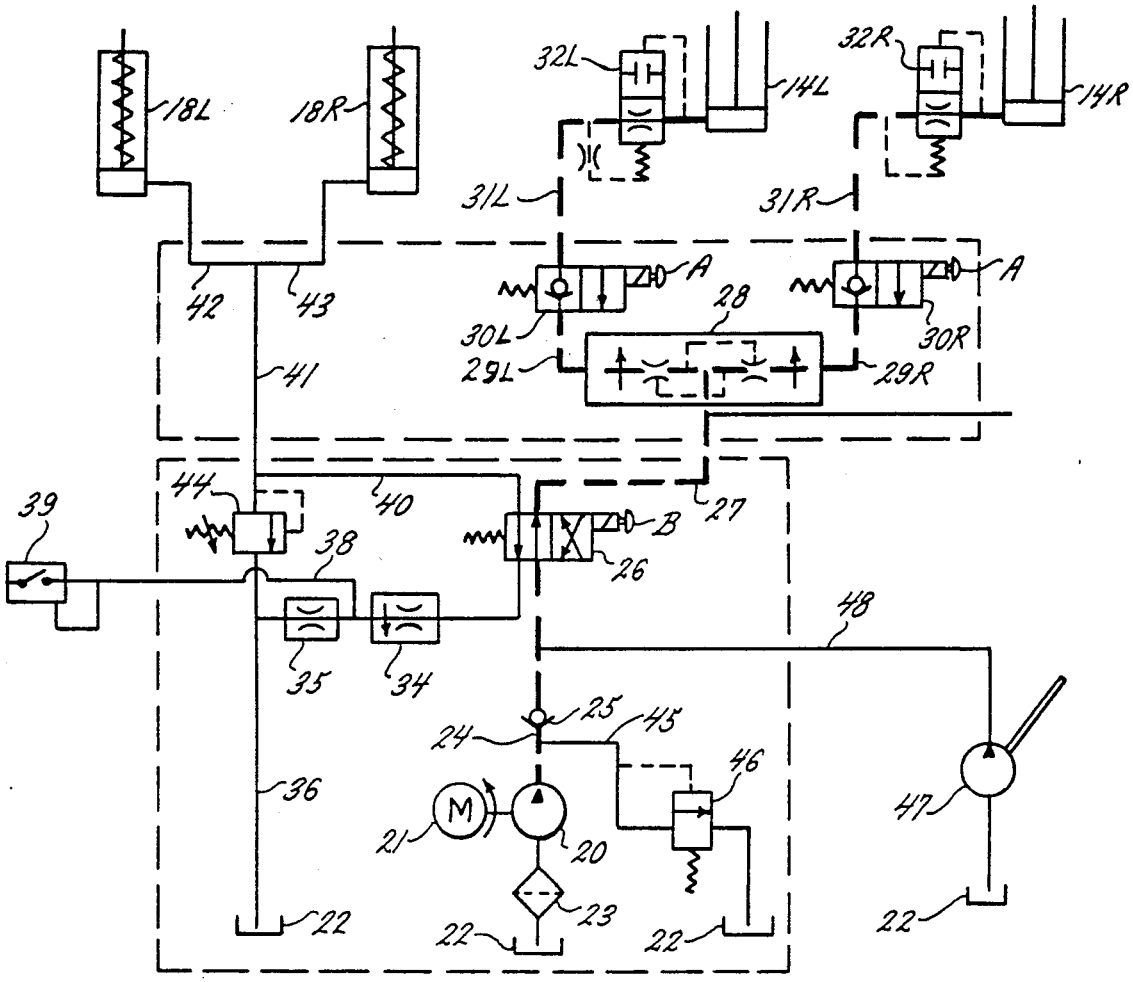
FIG. 8 is a schematic view similar to FIG. 7 showing the pressure fluid circuit activated for raising the runways.

Assuming that the runways 10 have received a vehicle which has passed over the run-on/run-off ramp R (FIG. 1), the pump motor 21 is energized by key unlocking the power switch 50 and turning it to power on at the console panel 51. Reference will be made to FIG. 8 and the fluid flow for raising the runways 10 as depicted by the conduits being shown in heavy dashed lines. Pressure fluid will be delivered to conduit 24 and pass through the four-way valve 26 which is shown in its normal rack raise settings and continue on to the divider/combiner 28. The latter device will allow substantially equal volumes of hydraulic fluid, independently of pressure, to flow into conduits 29L and 29R, and flow through the two-way valves 30L and 30R and the respective fuses 32L and 32R in the conduits 31L and 31R. Thus, the main motor means 14L and 14R will extend the power rods 14A substantially equally and raise the rack runways 10. As the runways 10 elevate, the ratchet means 16, 17 will allow the teeth of member 17 to click over the teeth on member 16. The operator will know that the safety means 16, 17 is functioning properly. An important and advantageous feature of the pressure fluid system resides in the installation of rubber or flexible wall hoses for the conduits 31L and 31R between the two-way valves 31L and 31R and the main motor means 14L and 14R to provide an accumulator effect which introduces a time cushion before the two-way valves 30L and 30R are required to be shut off. During the raising of the runways 10, the console button 52 for lifting the runways 10 must be held depressed until the runways 10 reach the desired elevation. At that elevation, the button 52 is released and lock button 53 must be depressed to release the pressure in the hydraulic system. When the engagement is heard, the lock button 53 is released and the power switch 50 is turned to its "off" position.

HYDRAULIC SYSTEM OPERATION ON RACK LOWERING

Figure 9:
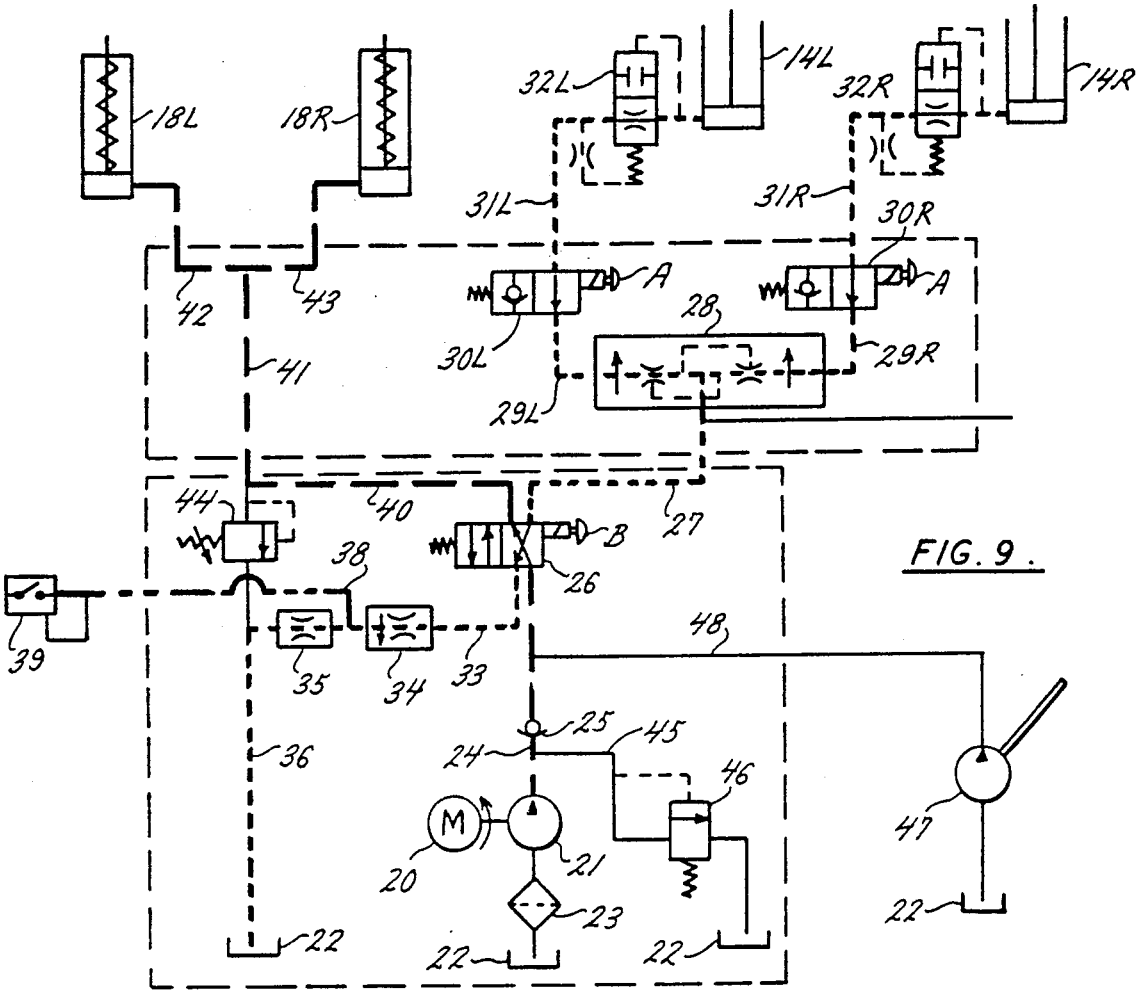
FIG. 9 is a further schematic view of the control system when certain control components are in position for lowering the runways.

The operation of the control system seen in FIG. 9 shows the fluid flow paths in heavy dashed lines for operating the ratchet release flow line. Now the return of the fluid from the motor means 14L and 14R to reservoir 22 is depicted by short dash lines. The system for lowering the rack runways 10 requires the power switch 50 (See FIG. 1) to be turned to the "on" position, and then the lowering button 54 must be depressed and held depressed until the runways 10 return to the fully down position. On full descent of the runways 10, the power switch 50 is turned to the "off" position. The key can then be removed. Before lowering can begin the motor means 14L and 14R must be energized to disengage the ratchet teeth (See FIG. 5). Pressing down button 54 energizes valves 30L, 30R and 26 at solenoids A and B, and pump motor 21 so that fluid will flow in conduit 40 and 41 to release the ratchets 17. Now as the runways 10 lower, hydraulic fluid is displaced from the motor means 14L and 14R in paths shown in short dash lines. That fluid passes through the two-way valve 30L and 30R, which have had the solenoid actuators A energized by depressing the button 54. That flow of fluid continues through the dividier/combiner 28 and back through the four-way valve 26 which has also been actuated by button 54 to energize solenoid B into its reversing setting seen in FIG. 9. Should a runway 10 encounter an obstruction to its lowering movement, it will stop its descent and the total flow of pressure fluid will be drastically reduced. For example, let it be assumed that the runway 10 seen in FIG. 9 meets an obstruction, that is the runway on the left side. The total flow of fluid in conduit 27 from the divider/combiner 28 will be reduced. As the flow is reduced in conduit 27 it is detected by the orifice device 35, and that reduction is sensed by the pressure switch 39 in conduit 38 which deenergizes the solenoids A at the two-way valves 30L and 30R which allows those valves to shut off so that neither runway can descend further. During the time the fluid flow at the divider/combiner 28 is reducing the flow, there would be very little flow from the conduit 29L and reduced flow from the conduit 29R due to the flow divider/combiner 28. That reduced flow condition is accounted for because of the fact that the conduits 31L and 31R are flexible wall conduits rather than solid wall tubes. This type of conduit provides an "accumulator effect" or a "time cushion" which does not require an immediate shut-off at the two-way valves 30L and 30R. The shut-off of these two-way valves must, however, occur before the flow in conduit 29L ceases completely and the flow at divider/combiner 28 shuts off flow completely, at which time fluid leakage through the divider/combiner would occur. It is important for the safety of the vehicle that the flow divider/combiner 28 and the pressure sensor 39, which is the shut-off control device, must be designed in conjunction with one another. This is necessary so that the time which elapses from the contact of runway 10 with an obstruction to the time the two-way valves 30L and 30R are shut off can be overcome during the initial elevating of the runways 10 on the next lift after the occurance of one of the runways 10 is being obstructed on its descent.

THE CHARACTERISTICS OF THE HYDRAULIC SYSTEM

Figure 1:
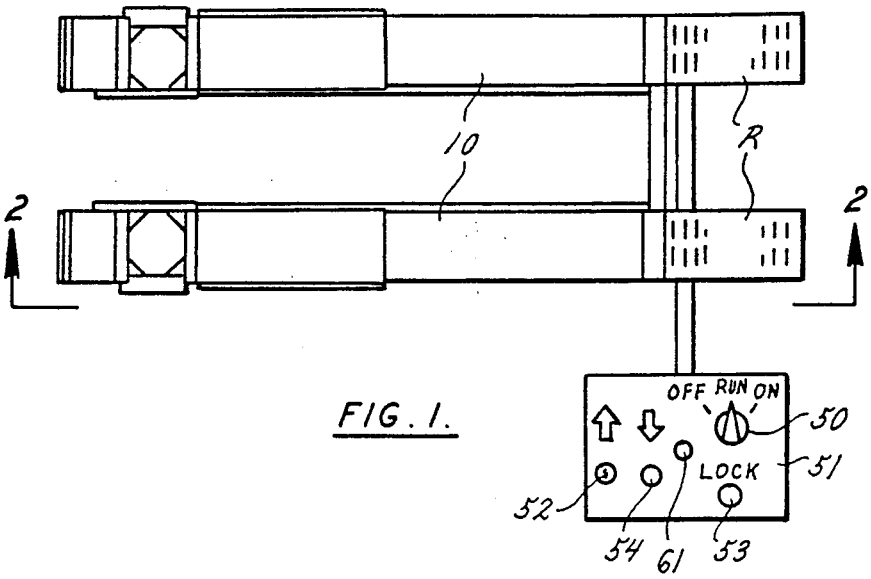
FIG. 1 is a schematic plan view of a pair of vehicle lift runways and a control console.

The hydraulic or pressure fluid system seen in FIG. 7 consists of an electric motor 21 driving pump 20 located in the housing for the console 51 (FIG. 1). The fluid from the reservoir 22 is forced by the pump 20 through the control valves 26, 30L and 30R to the motor means 14L and 14R to operate the lift rack. To lower the lift rack, the valves are switched in their setting so as to be able to return the fluid to the reservoir 22 through a path which contains certain control means.

The four-way valve 26 is electrically operated by solenoid means B to control the direction of the pressure fluid in the system. A main pressure relief valve 46 limits the maximum capacity of the rack, and the check valve 25 in the supply conduit 24 prevents high pressure damage to the hydraulic system.

The ratchet type mechanical lock means 16, 17 is protected from high pressure damage by a pressure relief valve 44. The pressure compensated flow controller means 34, as well as the orifice restrictor means 35, provide a pressure condition that is monitored by the pressure switch 39 when the runways 10 are being lowered.

When the runways 10 are to be elevated, the "up" button 52 at the console 51 is pressed and held pressed so the pump motor 21 operates, but when released, the motor 21 stops. The four-way valve 26 in its normally open position (of FIG. 7) is able to direct pressure fluid to the divider/combiner 28. The divider/combiner 28 divides the fluid flow substantially equally to the two-way valves 30L and 30R and thence to both motor means 14L and 14R. An important function of the divider/combiner 28 is to compensate for unequal weight on the runways 10 so they will be substantially level when raised regardless of the load distribution. The normal setting of the two-way valves 30L and 30R is shown in FIGS. 7 and 8 to allow for elevating the runways, while internal check valves stop reverse flow, or to prevent flow from motor means 14L to motor means 14R, or reversely from motor means 14R to 14L. Each motor means 14L and 14R is provided with the same ratchet locking means, which locking means functions to maintain the position of the runways 10 if pressure fluid is lost.

When the runways 10 are at the required elevation for service on a vehicle, the mechanical locks should be engaged by pressing on the lock button 53 at the console. This button electrically operates the four-way valve 26 and both two-way valves 30L and 30R to release pressure fluid from the motor means 14L and 14R so the weight of the runways will be applied to the mechanical locks 16, 17. When this condition is established, the four-way valve 26 and the two-way valves 30L and 30R return to the positions of FIG. 7.

The runway lowering procedure is to press the down button 54 and hold it pressed until the runways are either down all the way or at a desired position. When button 54 is pressed, the pump 22 is operated momentarily to supply pressure fluid to the main motor means 14L and 14R to lift the weight off the mechanical locks 16, 17. After a short time interval, the four-way valve 26 is electrically operated at solenoid B to shift the valve so the pressure fluid actuates the motor means 18L and 18R at each of the ratchets 16, 17 to release the mechanical locks and hold them released under the desired pressure of valve 44. The pump 20 then is shut off.

Both two-way valves 30L and 30R are electrically operated by solenoids at A to shift to the positions of FIG. 9 so the pressure fluid can be released from the motor means 14L and 14R. The released flow is through the divider/combiner 28 so the runways 10 remain level as they lower, and the flow continues through four-way valve 26 that is still in the position of FIG. 9 so the flow passes through the pressure compensation flow control 34 and the orifice 35 on its way back to the reservoir 22 through conduit 36. The pressure compensated fixed flow valve 34 and the orifice restrictor 35 together provide a pressure level that is detected by the pressure switch 39 connected up by conduit 38. If the pressure in the conduit 38 is below a set or predetermined value, depending on the size of the orifice in restrictor 35, the pressure switch 39 will open an electrical circuit and cause power cut-off to the solenoids A to close two-way valves 30L and 30R so no further lowering of the runways 10 can be experienced.

Each runway operating motor means 14L and 14R is provided with a flow velocity fuse 32L and 32R respectively. The fuses monitor the maximum flow rate out of the respective motor means 14L and 14R. If the flow rate from either motor means 14L or 14R exceeds the predetermined size of the fuses, the sensing fuse will trip and stop the flow from that motor means. That reduced flow will create a lower pressure at the pressure switch 39, and that switch will open the electrical circuit at the solenoid means A of two-way valves 30L and 30R and valve 26 to return those valves to the positions of FIG.

7 which stops the release of fluid from both of the motor means 14L and 14R to stop lowering of the runways 10.

Figure 11:
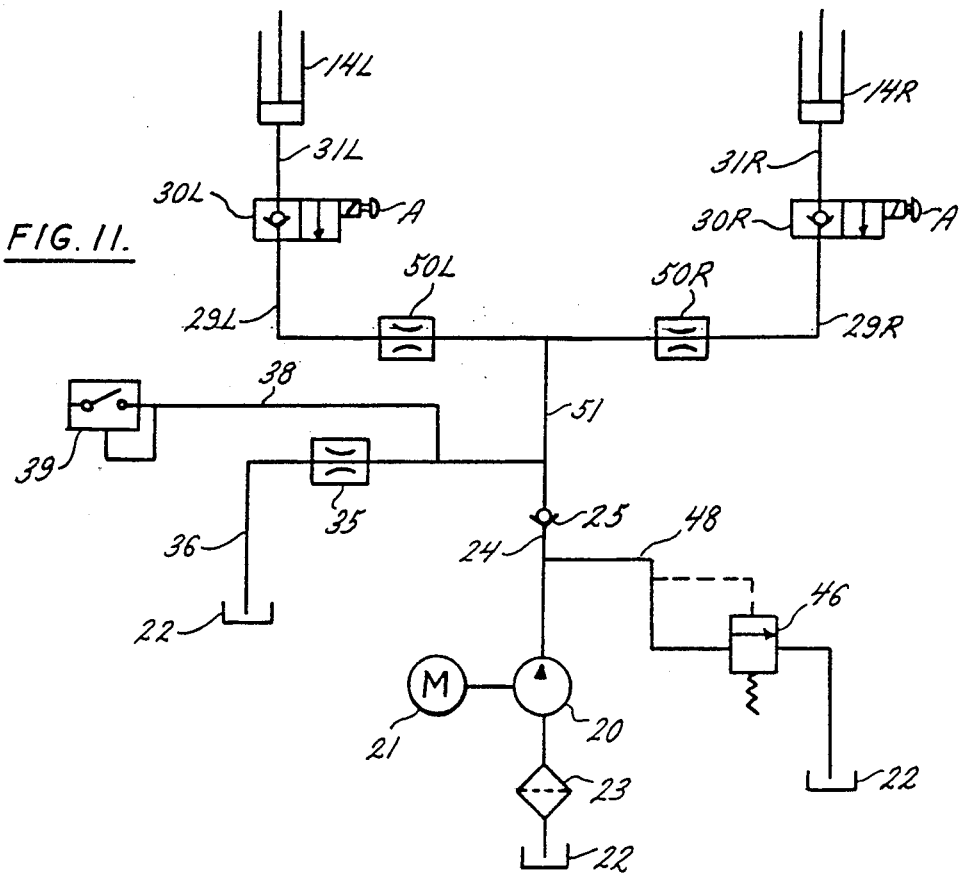
FIG. 11 is a schematic pressure fluid diagram of a simplified arrangement of components.

Turning now to FIG. 11, there is shown in that embodiment a pressure fluid circuit for the runway elevating motor means 14L and 14R. As before noted, a motor 21 drives a pump 20 which draws fluid from the reservoir 22 through a suitable filter 23 and directs it into delivery conduit 24 past a check valve 25. The usual pressure relief valve 46 is connected to pump output conduit 24 in advance of the check valve 25 so that the occurance of a back pressure which holds check valve 25 closed to pump output will be relieved through the pressure valve 46, as is well understood. Assuming that the runways 10 are to be raised, the operation of the pump 20 will supply pressure fluid to the flow control valve 50L and 50R inserted in conduits 29L and 29R which include the two-way valves 30L and 30R as before described. The pressure fluid continues through the conduits 31L and 31R to the runway motor means 14L and 14R. When lowering the runways 10, the pump can be shut-off and, with reference to the console panel in FIG. 1, the down button 54 is pressed to activate the solenoids A to shift the two-way valves 30L and 30R to allow return flow of the fluid from motor means 14L and 14R through the system and back to the reservoir 22 by way of the flow controller orifices 50L and 50R, the conduit 51, orifice 35 and return conduit 36.

If an obstruction is encountered by either runway during lowering, there will be a reduction in the flow thorugh conduit 51 and orifice 35. The result of this is that the pressure sensing switch 39 will operate to deenergize the solenoids A at the two-way valves 30L and 30R. That action allows those valves to shift so the check valves stop further flow out of the motor means 14L and 14R, thereby stopping the descent of the unobstructed runway. The obstruction can be removed and the runway descent resumed.

Figure 12:
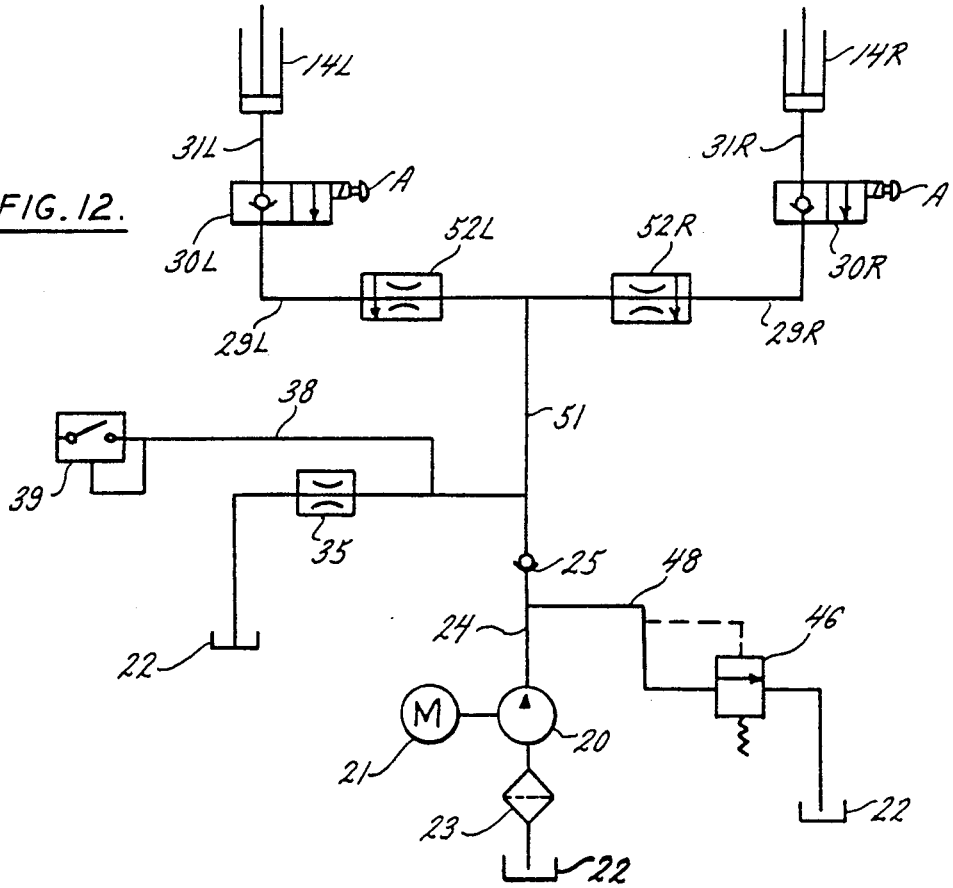
FIG. 12 is a view similar to FIG. 11 with certain modifications over the diagram seen in FIG. 11.

In FIG. 12, the circuit components are essentially like those in FIG. 11 with the exception that the flow controllers 52L and 52R are adjustable and pressure compensated for flow control.

Figure 10:
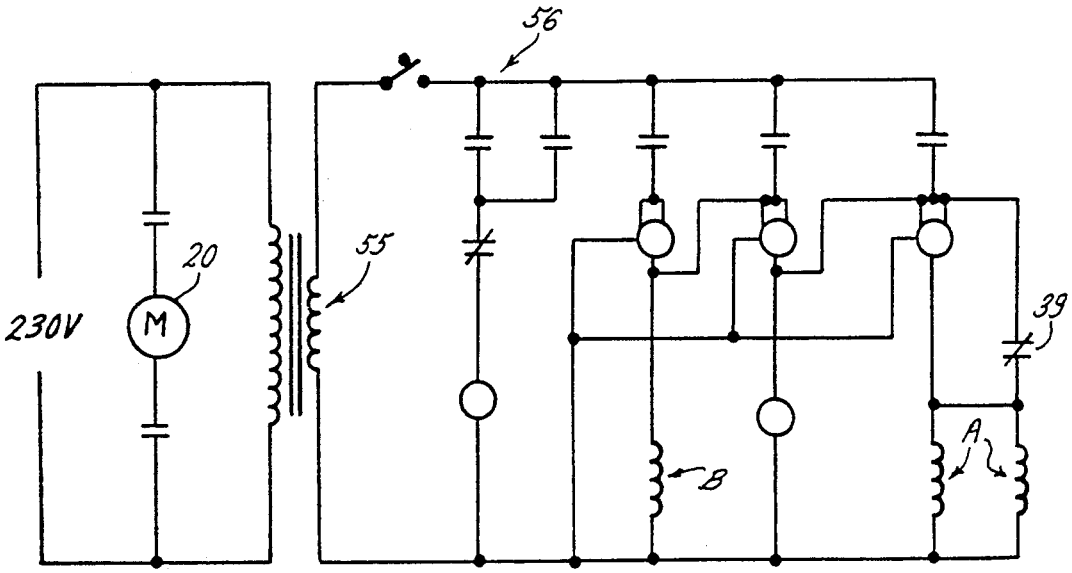
FIG. 10 is a schematic wiring diagram associated with the console station seen in FIG. 1.
Figure 13:
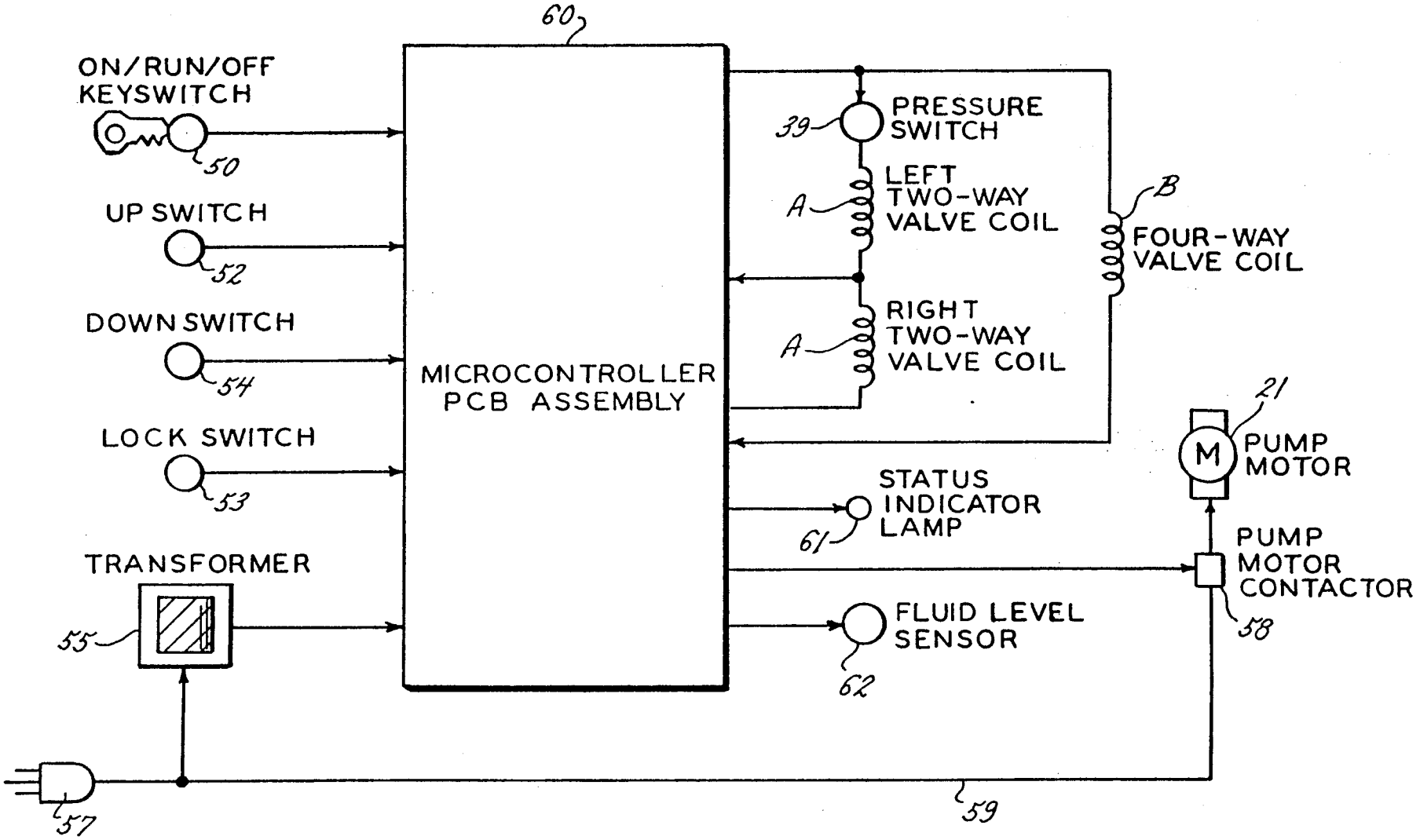
FIG. 13 is a block diagram of the electrical control system.

Turning to FIGS. 10 and 13, there is shown the electrical circuits for the apparatus disclosed in other drawing views. In FIG. 10 there is shown a general wiring diagram in which the power supply to the pump motor is indicated to be a 230 V supply. That circuit is stepped down by a transformer 55 to a low power circuit 56 of 24 V for example. The latter circuit 56 includes the pressure switch 39, the solenoids A for each of the two-way valves 30L and 30R, and the solenoid B associated with the four-way valve 26.

FIG. 13 is a diagram disclosing, in different detail, the components in a wiring arrangement suitable for the apparatus seen in FIGS. 1, 5, 7, 8 and 9. For example, the power input adapter 57 supplies power to the transformer 55, and to a pump motor contact 58 in the circuit 59 to the pump drive motor 21. The general circuit is contained in the microcontroller printed circuit board 60, and that circuit is provided with a key actuated on/run/off switch 50, as well as buttons or switches 52 for selecting lift operation of the rack runways 10, button or switch 54 for selecting descent of the runways 10, and button or switch 53 for operating the ratchet motor means 18 for unlocking the ratchet member 14.

The circuit of FIG. 13 also depicts the association of the pressure switch 39 for controlling the energization of the solenoids A at two-way valves 30L and 30R, and the solenoid B at the four-way valve 26. In addition, FIG. 13 shows the status indicator lamp 61 which is energized when the key switch 50 is turned on. If the circuits to the various components are operative, the lamp will provide a steady beam, but if a circuit has developed a malfunction, the lamp 61 will blink to call attention to a problem. While a reservoir level sensor 62 is provided, a manual dip-stick can supply the method for checking the adequacy of the fluid in reservoir 22.

While the foregoing description has set forth a control system for vehicle lift racks of the type having a parallelogram type pair of lifting arms, it should be understood that the pressure fluid motor means may include three or more pairs thereof associated with an elongated pair of runways to accommodate exceptionally long wheel base type vehicles, and it is also understood that the pressure fluid motor means may be operatively associated with a lift system having two or four vertically directed ram units to which the vehicle supporting runways are operatively associated for vehicle servicing.

The embodiments of the invention in which an exclusive property or privilege is sought are described above and are intended to include equivalent components.

What is claimed is:

1. A control system for vehicle lift racks comprising in combination:

(a) a pair of runways on which a vehicle may be lifted and lowered;

(b) a pump and a source of fluid;

(c) a fluid circuit to accommodate the flow of fluid under pressure by said pump from said source of fluid;

(d) a plurality of pressure fluid directing valve means in said fluid circuit, one of said plurality of fluid directing valve means having a first setting for establishing a first path for pressure fluid into other ones of said plurality of pressure fluid directing valve means to effect the operation of said runways for lifting a vehicle;

(e) said one of said plurality of pressure fluid directing valve means being operable to create a second path for the return of fluid to said source of fluid in bypass of said pump for lowering the runways for lowering a vehicle;

(f) an electrical control circuit for energizing said pump and said plurality of pressure fluid directing valve means in a predetermined sequence;

(g) control means for selectively managing said electrical control circuit and said plurality of pressure fluid directing valve means, said control means having a vehicle lift selector means to supply pump operated fluid to effect runway lifting of a vehicle, and a vehicle selector lowering means for stopping pump supply of fluid and directing the fluid into said created second path for the return of fluid in bypass of said pump operated source of fluid; and cooperative means connected into said second path which receives the return of fluid in bypass of said pump so as to be responsive to the occurrence of a predetermined reduced fluid flow in bypass of said pump for effecting the closing of said other ones of said plurality of pressure fluid directing valve means to arrest the lowering of a vehicle.

2. A control system for vehicle lift racks comprising in combination:

(a) a pair of runways on which a vehicle may be lifted and lowered;

(b) motor means connected to each of said runways for operatively effecting the lifting and lowering of said runways;

(c) a pump operated source of pressure fluid;

(d) a pressure fluid conduit system connected from said pump operate source of pressure fluid to each of said runway connected motor means, said conduit system including a flow control valve associated with each of said runway motor means, a pair of two-way valve means in said conduit system inserted one each between a flow valve means and the associated runway motor means;

(e) a bypass conduit system connected into said first mentioned conduit system and including an orifice device and a pressure responsive switch, said bypass conduit system being effective to return fluid tot he source of pressure fluid in bypass of said pump operated source of pressure fluid;

(f) electrically responsive operator means operably connected to each of said two-way valve means for selecting the direction of flow of fluid selectively toward said motor means for lifting the runways and reversely for lowering the runways by directing the fluid flow into said bypass conduit system; and (g) control means connected to said electrically responsive operator means and said pressure responsive switch for initiating vehicle lift by operating said pair of two-way valve means in a vehicle lift mode, and for operating said pair of two-way valve means in vehicle lowering mode to effect reverse flow in bypass of said pump operated source of pressure fluid, and wherein said control means is operated by said pressure responsive switch, upon the occurrence of a decrease in the flow of fluid in said bypass conduit system, to operate said pair of two-way valve means to cease reverse flow of fluid, whereby lowering of said vehicle runways is stopped.

* * * * *